United States Patent [19]

McNamara

[11] Patent Number: 4,930,461

[45] Date of Patent: Jun. 5, 1990

[54] ONE-PIECE LOST FOAM PATTERN FOR AN INTAKE MANIFOLD

[75] Inventor: Don B. McNamara, Menomonee Falls, Wis.

[73] Assignee: Outboard Marine Corporation, Waukegan, Ill.

[21] Appl. No.: 389,864

[22] Filed: Aug. 4, 1989

[51] Int. Cl.[5] ..... F02M 35/10

[52] U.S. Cl. ..... 123/52 M; 123/73 A

[58] Field of Search ..... 123/52 M, 52 MC, 52 MB, 123/73 A

[56] References Cited

U.S. PATENT DOCUMENTS

| | | | |
|---|---|---|---|
| 4,197,899 | 5/1980 | Ernest | 164/34 |
| 4,244,332 | 1/1981 | Kusche et al. | 123/52 M |
| 4,345,551 | 8/1982 | Bloemers | 123/73 A |
| 4,632,169 | 12/1986 | Osborn | 164/45 |
| 4,640,333 | 2/1987 | Martin et al. | 164/246 |
| 4,784,090 | 11/1988 | Sougawa | 123/73 A |

*Primary Examiner*—David A. Okonsky

*Attorney, Agent, or Firm*—Michael, Best & Friedrich

[57] ABSTRACT

Disclosed herein is a one-piece foam pattern for an intake manifold for a two cycle internal combustion engine, which pattern comprises a first surface for providing an intake manifold surface adapted to engage an engine block surface and having therein a generally rectangular opening, a second surface extending in generally spaced and parallel relation to the first surface and for providing an intake manifold surface adapted to engage a carburetor mounting surface, which second surface has therein a generally cylindrical opening, and a passage extending between the first and second surfaces and adapted to provide a fuel/air mixture passage in the intake manifold, which passage includes a first portion extending from the rectangular opening in the first surface and having a first transverse surface extending parallel to, and in spaced relation to, the first and second surfaces and having therein a second rectangular opening, which passage also includes a transition portion extending between the circular opening in the second surface and the second rectangular opening and is defined by a semi-cylindrical wall extending from the circular opening in the second surface and including a first axial end at the second surface and a second axial end spaced from the first end, a second wall extending from the second end of the semi-cylindrical wall to the second rectangular opening and in generally parallel relation to the second surface, and a third wall extending from the circular opening and diverging to the second rectangular opening.

8 Claims, 4 Drawing Sheets

ONE-PIECE LOST FOAM PATTERN FOR AN INTAKE MANIFOLD

BACKGROUND OF THE INVENTION

1. Field of the Invention

The invention relates generally to pattern assemblies for the lost foam casting process. More particularly, the invention relates to lost foam pattern assemblies for intake manifolds for two-stroke engines.

2. Reference to Prior Art

Shown in FIGS. 1 through 4 of the drawings is a prior lost foam pattern assembly 11 for an intake manifold (not shown) for a two-stroke internal combustion engine (not shown).

The pattern assembly 11 corresponds essentially identically to the resulting intake manifold and includes four fuel/air mixture passages 13 which, in the assembled engine, extend from four carburetors (not shown) to four crankcases (not shown) in an engine block (not shown).

The pattern assembly 11 includes a first or engine block mounting surface 15 adapted to engage the engine block and having therein four generally rectangular openings 17.

The pattern assembly 11 also includes a second or carburetor mounting surface 19 which extends in spaced generally parallel relation to the first or engine block mounting surface 15 and which includes four generally indentical circular openings 21.

The four fuel/air mixture passages 13 extend between the circular openings 21 in the carburetor mounting surface 19 and the rectangular openings 17 in the engine block mounting surface 15.

The fuel/air mixture passages 13 are generally identical and each includes (See FIGS. 2 and 3) a rectangular portion 31 extending inwardly from the associated rectangular opening 17 in the engine block mounting surface 15 and including a transverse reed valve mounting surface 33 which, in the assembled engine, engages and supports a reed valve (not shown) and which extends generally parallel to the mounting surfaces 15 and 19 and has therein a second rectangular opening 35 of somewhat smaller size than the rectangular openings 17 in the engine block mounting surface 15. The rectangular opening 35 in the reed valve mounting surface 33 is defined by two long side edges 37 and 39 and two end edges 41 and 43. The side edge 37, when projected perpendicularly to the carburetor mounting surface 19, approximately bisects the associated circular opening 21, and the other side edge 39 lies outside the periphery of the associated circular opening 21.

The rectangular portion 31 of each fuel/air mixture passage 13 is also defined by two long side walls 47 and 49 and two short end walls 51 and 53. The long side wall 49 and the short end walls 51 and 53 extend at an obtuse angle with respect to the engine block mounting surface 15. In the disclosed construction, the angle is slightly larger than 90°. The other long side wall 47 defines an acute angle of somewhat less than 90° with respect to the engine block mounting surface 15 and thus defines (See FIG. 3) an undercut area 61 with respect to a die member (not shown) moving in a direction perpendicularly to, and away from, the engine block mounting surface 15.

Each fuel/air mixture passage 13 also includes (See FIGS. 1 and 3) a transition portion 71 which extends between the associated circular opening 21 in the carburetor mounting surface 19 and the associated rectangular opening 35 in the reed valve mounting surface 33. The transition portion 71 of each fuel/air mixture passage 13 is defined by first wall means 73 extending from approximately one-half of the periphery of the associated circular opening 21 in the carburetor mounting surface 19 and to the side edge 3 and to the end edges 41 and 43 of the rectangular opening 35 in the reed block mounting surface 33. The first wall means 73 includes suitable draft to facilitate withdrawal of a die member (not shown) perpendicularly to, and from, the engine block mounting surface 15.

The transition portion 71 of each of the fuel/air mixture passages 13 is also defined by second wall means 83 extending from the other half periphery of the associated circular opening 21 in the carburetor mounting surface 19 and to the other side edge 37 of the rectangular opening 35 in the reed block mounting surface 33.

The second wall means 83 extends, in part, radially outwardly of the associated circular opening 21 and to the ends of the side edge 37 of the rectangular opening 35 in the reed valve mounting surface 33, thus defining (See FIG. 1) two additional undercut areas indicated at 85 and 87 and located below the carburetor mounting surface 19.

In addition, the outer or exterior surface 89 of the second wall means 83 extends radially inwardly of the other half periphery of the associated circular opening 21 in the carburetor mounting surface 19, thereby providing a further undercut area 91 associated with each of the fuel/air mixture passages 13.

Accordingly, in order to obtain the pattern assembly 11, the assembly 11 was divided into a base piece 93 defining the engine block mounting surface 15, the four rectangular passage portions 31, approximately one-half of the carburetor mounting surface 19, and the first wall 73 means partially defining the transition portion 71 of the four fuel/air mixture passages 13. The second wall means 83 which defines the transition portion 71 of the four fuel/air mixture passages 13 and the remaining approximately one-half of the carburetor mounting surface 19 were provided by four additional pieces 95 which were glued to the base piece 93 as indicated in FIG. 1 to provide the resulting pattern assembly 11.

SUMMARY OF THE INVENTION

The invention provides a one-piece foam pattern for an intake manifold for a two cycle internal combustion engine, which pattern comprises a first surface for providing an intake manifold surface adapted to engage an engine block surface and having therein a first opening, a second surface extending in generally spaced relation to the first surface and for providing an intake manifold surface adapted to engage a carburetor mounting surface, which second surface has therein a generally cylindrical opening, and a passage extending between the first and second surfaces and adapted to provide a fuel/air mixture passage in the intake manifold, which passage includes a first portion extending from the first opening in the first surface and having a first transverse surface extending in spaced relation to the first and second surfaces and having therein a second opening, which passage also includes a transition portion extending between the circular opening in the second surface and the second opening and being defined by semicylindrical wall means extending from the circular opening in the second surface and including a first axial end at the second surface and a second axial end spaced from the first end, second wall means extending from the second end of the semi-cylindrical wall means to the second opening and defining a second transverse wall, and third wall means extending from the circular opening and diverging to the second opening.

The invention also includes a one-piece foam pattern for an intake manifold for a two cycle internal combustion engine, which pattern comprises a first surface for providing an intake manifold surface adapted to engage an engine block surface and having therein a generally rectangular opening, a second surface extending in generally spaced and parallel relation to the first surface and for providing an intake manifold surface adapted to engage a carburetor mounting surface, which second surface has therein a generally cylindrical opening, and a passage extending between the first and second surfaces and adapted to provide a fuel/air mixture passage in the intake manifold, which passage includes a first portion extending from the rectangular opening in the first surface and having a first transverse surface extending parallel to, and in spaced relation to, the first and second surfaces and having therein a second rectangular opening, which passage also includes a transition portion extending between the circular opening in the second surface and the second rectangular opening and being defined by semi-cylindrical wall means extending from the circular opening in the second surface and including a first axial end at the second surface and a second axial end spaced from the first end, second wall means extending from the second end of the semi-cylindrical wall means to the second rectangular opening and defining a second transverse wall generally parallel to the second surface, and third wall means extending from the circular opening and diverging to the second rectangular opening.

The invention also provides a one-piece foam pattern for an intake manifold for a two cycle internal combustion engine, which pattern comprises a first surface for providing an intake manifold surface adapted to engage an engine block surface and having therein a generally rectangular opening, a second surface extending in generally spaced and parallel relation to the first surface and for providing an intake manifold surface adapted to engage a carburetor mounting surface, which second surface has therein a generally cylindrical opening, and a passage extending between the first and second surfaces and adapted to provide a fuel/air mixture passage in the intake manifold, which passage includes a first portion extending from the rectangular opening in the first surface and having a first transverse surface extending parallel to, and in spaced relation to, the first and second surfaces and having therein a second rectangular opening of lesser size than the rectangular opening in the first surface, which second rectangular opening is defined by two end edges and by a first side edge extending in a plane generally bisecting the cylindrical opening and approximately dividing the cylindrical opening into first and second half portions, which first side edge has a central portion and first and second end portions extending from the central portion, and which second rectangular opening also is also defined by a second side edge, which passage also includes a transition portion extending between the circular opening in the second surface and the second rectangular opening and is defined by semi-cylindrical wall means extending from the first half portion of the circular opening in the second surface and includes a first axial end at the second surface, a second axial end spaced from the first end, and first and second arcuately spaced and axially extending sides, and second wall means extending from the second end of the semi-cylindrical wall means to the central portion of the first side edge of the second rectangular opening and defining a second transverse wall generally parallel to the second surface, third wall means extending from the second half portion of the circular opening and diverging to the second side edge and to the end edges of the second rectangular opening, fourth wall means extending from the first side of the semi-cylindrical wall means to the first end portion of the first side edge and extending to the third wall means, and fifth wall means extending from the second side of the semi-cylindrical wall means to the second end portion of the first side edge and extending to the third wall means.

Other features and advantages of the invention will become apparent to those skilled in the art upon review of the following detailed description, claims, and drawings.

THE DRAWINGS

Figure 2:
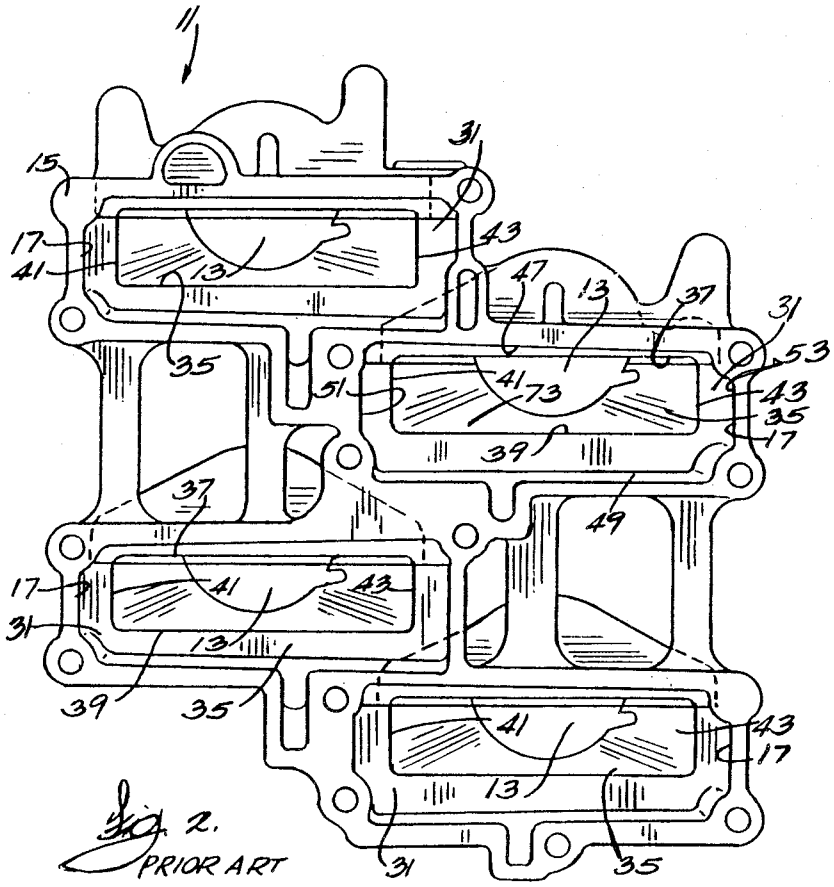
Fig. 2. PRIOR ART
FIG. 2 is a plan view from the opposite surface of the prior multi-piece lost foam pattern assembly shown in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION

Figure 1:
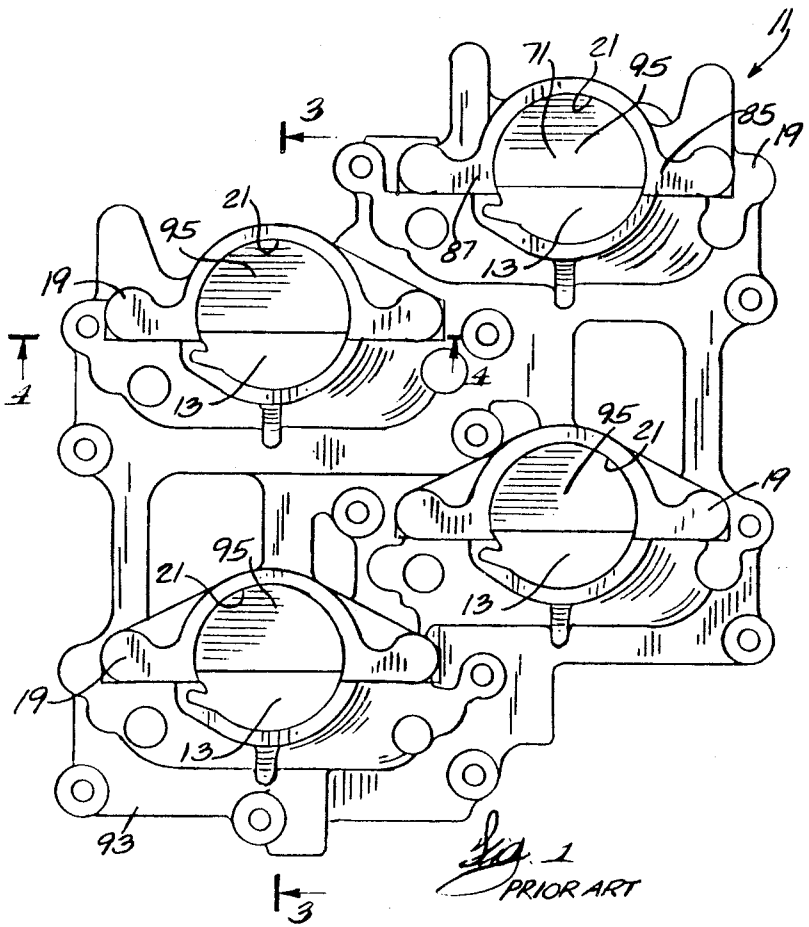
Fig. 1 PRIOR ART
FIG. 1 is a plan view of one surface of a prior multi-piece lost foam pattern assembly.
Figure 3:
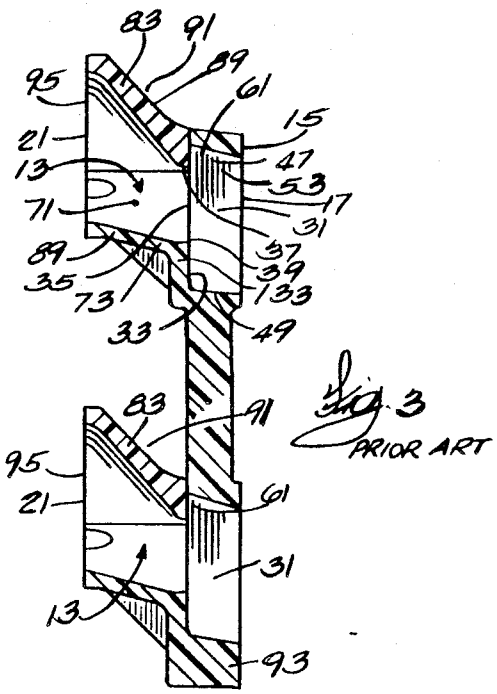
Fig. 3 PRIOR ART
FIG. 3 is a sectional view taken along line 3—3 of FIG. 1.
Figure 4:
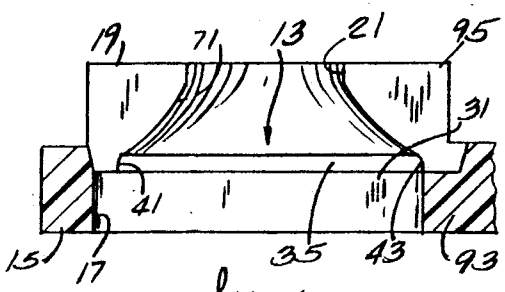
Fig. 4 PRIOR ART
FIG. 4 is a sectional view taken along line 4—4 of FIG. 1.
Figure 9:
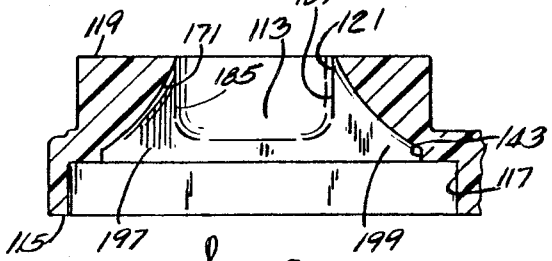

Shown in FIGS. 5 through 8 is a one-piece lost foam pattern 111 which is adapted for casting an intake manifold (not shown) which can be substituted in the field for the intake manifold provided by the prior pattern assembly 11 shown in FIG. 1. Accordingly, the one-piece lost foam pattern 111 includes a first surface 115 adapted to provide an engine block mounting surface, which first surface 115 includes four rectangular openings 117 and a plurality of mounting holes 118 for receiving mounting bolts (not shown) for connecting the engine block (not shown) and the intake manifold (not shown). The one-piece lost foam pattern 111 also includes (See FIG. 5) a second surface 119 adapted to provide a carburetor mounting surface, which second surface 119 includes four circular openings 121 and a plurality of bosses 122 into which holes (not shown) are provided for receiving mounting bolts (not shown) for connecting four carburetors (not shown) and the intake manifold.

The one-piece lost foam pattern 111 also includes four fuel/air mixture passages 113 respectively extending between the circular openings 121 and the rectangular openings 117. The fuel/air mixture passages 113 are generally identical and each includes (See FIGS. 7 and 8, a rectangular portion 131 which is generally identical to the rectangular portion 31 of the fuel/air mixture passages 13 of the prior pattern assembly 11. In this regard, each fuel/air mixture passage 113 of the one-piece pattern 111 also includes a transverse wall surface 133 which is generally identical to the transverse wall surface 33 in the prior pattern assembly 11 and which has a rectangular opening 135 with first and second side edges 137 and 139 and wit first and second end edges 141 and 143. The first side edge 137 generally lies in a plane which is perpendicular to the surfaces 115 and 119 and which generally bisects the associated circular opening 121 and includes a central portion 142, as well as first and second end portions 144 and 146 extending from the central portion 142.

In addition, and as in the prior lost foam pattern assembly 11, each of the fuel/air mixture passages 113 also includes a transition portion 171. More particularly, in the one-piece lost foam pattern 111, each transition portion 171 includes first wall means 175 defining a semi-cylindrical wall which extends from about one-half of the associated circular opening 121 and which includes a first axial end 177 at the second or carburetor mounting surface 119 and a second axial end 179 spaced from the first end 177. The first or semi-cylindrical wall means 175 is constructed such that a radially extending cross-section defines an internal wall 181 and an external wall 183, both of which include suitable draft to facilitate withdrawal of a die member (not shown) in the direction away from the second or carburetor mounting surface 119. The semi-cylindrical wall means 175 also includes (See FIG. 5) first and second angularly spaced and axially extending side edges of margins 185 and 187.

Figure 6:
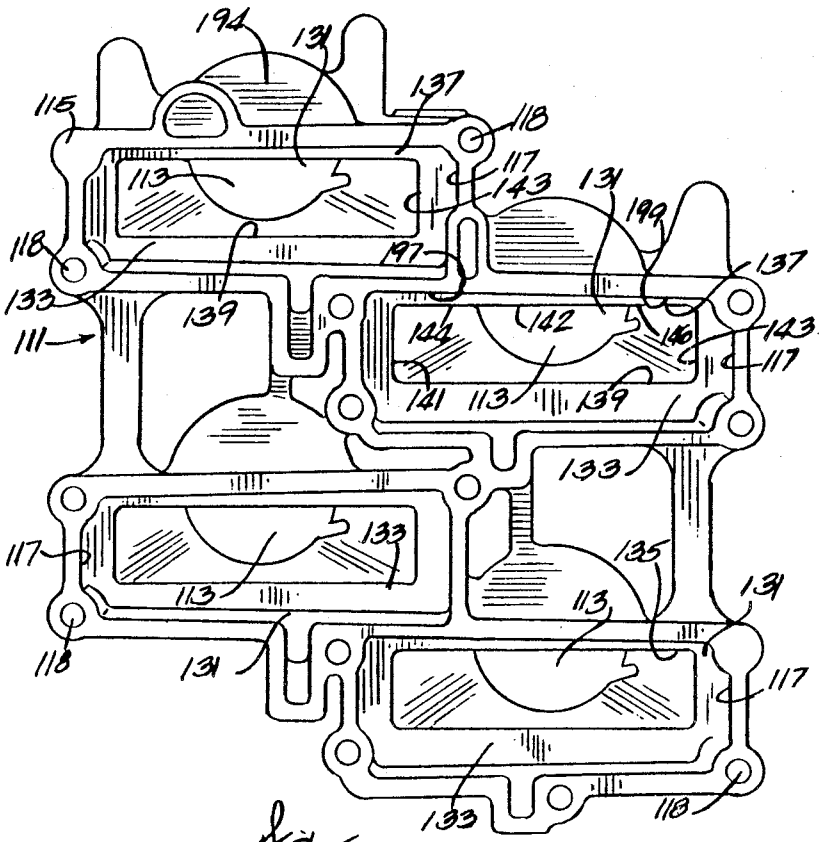
FIG. 6 is a plan view of the opposite surface of the one-piece lost foam pattern shown in FIG. 5.
Figure 5:
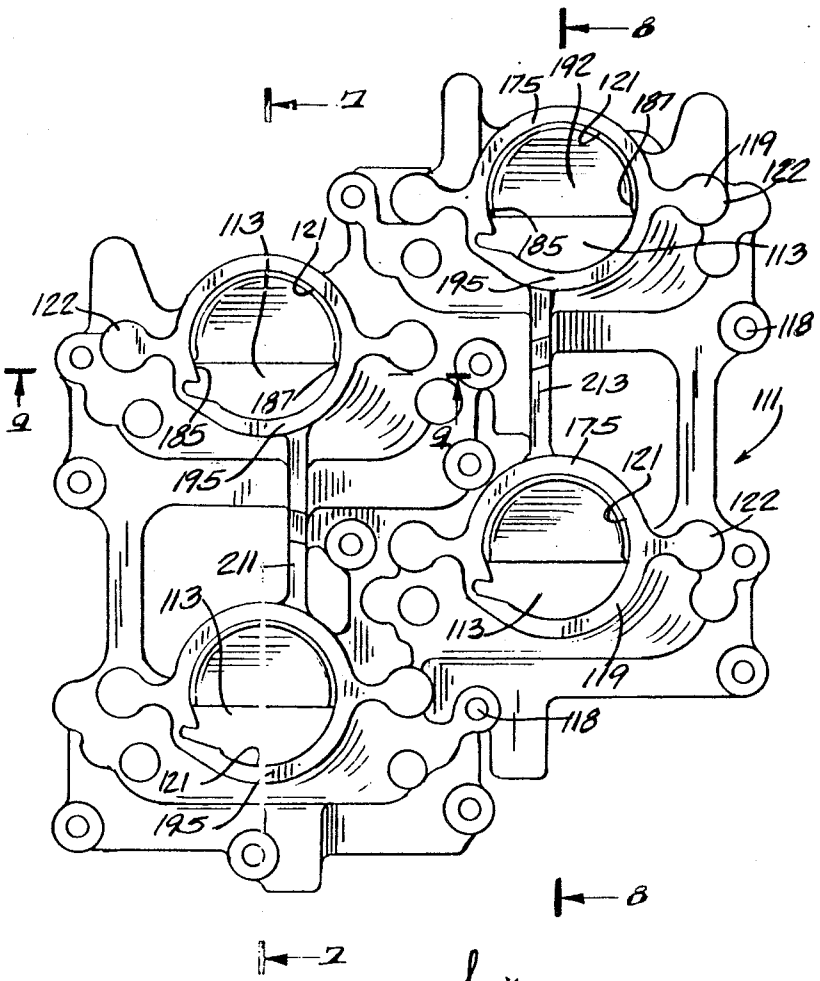
FIG. 5 is a plan view of one surface of a one-piece lost foam pattern embodying various of the features of the invention.
Figure 8:
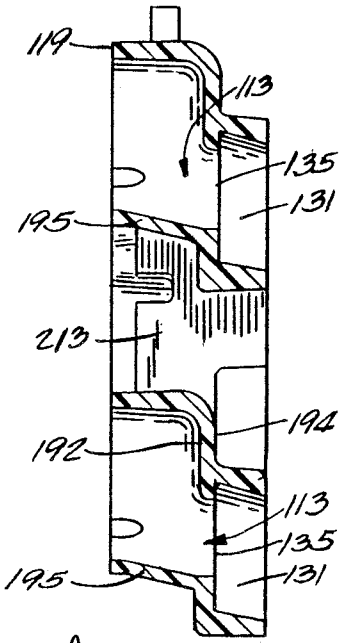
FIG. 8 is a sectional view taken along line 8—8 of FIG. 5.
Figure 7:
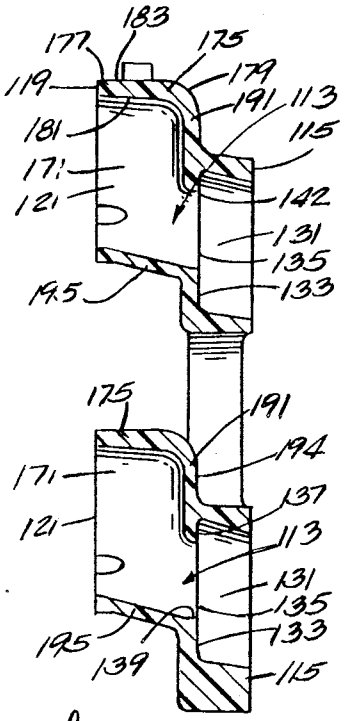
FIG. 7 is a sectional view taken along line 7—7 of FIG. 5.

Each transition portion 171 also includes a transverse wall 191 which extends from the second end 179 of the semi-cylindrical wall 175 in generally planar relation to the second or carburetor mounting surface 119 and to the central portion 142 of the side edge 137 of the rectangular opening 135 in the transverse wall 133, which side edge 137 lies in a plane which is perpendicular to the surfaces 115 and 119 and which generally bisects the associated circular opening 121, as already pointed out. The transverse wall 191 includes, as shown in FIG. 5, on the carburetor mounting side, an inner surface 192, and, as shown in FIG. 6, on the engine block side, and an outer surface 194.

Each transition portion 171 also includes third wall means 195 which extends from the other half portion of the associated circular opening 121 and to the other side edge 139 and to the two end edges 141 and 143 of the rectangular opening 135 in the transverse wall 133. The third wall means 195 is generally identical to the wall means 89 in the prior pattern assembly 11.

Each transition portion 171 is also defined by a first flat or fourth wall means 197 which extends from the first axially extending side margin 185 of the semi-cylindrical wall means 175 and to the end portion 144 of the bisecting side edge 137 and which intersects the third wall means 195. The first flat or fourth wall means 197 includes suitable draft to facilitate withdrawal of a die member (not shown) perpendicularly to, and from, the first or engine block mounting surface 115.

Each transition portion also includes a second flat or fifth wall means 199 which extends from the second axially extending side margin 187 of the semi-cylindrical wall means 175 and to the other end portion 146 of the bisecting side edge 137 and which intersects the third wall means 175. The second flat or fifth wall means 199 includes suitable draft to facilitate withdrawal of a die member (not shown) perpendicularly to, and from, the first or engine block mounting surface 115.

The one-piece lost foam pattern 111 also includes rigidifying means extending between the transition portions 171 of the fuel/air mixture passages seen to the left in FIG. 5 and between the transition portions 171 of the fuel/air mixture passages seen to the right in FIG. 5. While other constructions can be employed, in the disclosed construction, such means comprises a first rib 211 extending directly between the semi-cylindrical wall means 175 of the fuel/air mixture passage shown at the lower left in FIG. 5 and the third wall means 195 of the fuel/air mixture passage shown at the upper left in FIG. 5 and in generally perpendicular relation to the side edges 137 and 139 of the rectangular openings 135. In addition, such means includes a second rib 213 extending directly between the semi-cylindrical wall means 175 of the fuel/air mixture passage shown at the bottom right in FIG. 5 and the third wall means 195 of the fuel/air mixture passage shown at the upper right in FIG. 5 and in generally parallel relation to the first rib 211.

The disclosed construction permits formation of the one-piece pattern 111 by first and second die members (not shown) movable relative to each other, the first die member forming the first or engine block mounting surface 115, as well as the rectangular portions 131 of the fuel/air mixture passages 113 and the bottom outer surfaces 194 of the transverse walls 191, and the third, fourth and fifth wall means 195, 197 and 199. In addition, the first die member forms the surfaces extending directly from the first or engine block mounting surface 115 and not otherwise mentioned as being formed by the second die member.

The second die member forms the second or carburetor mounting surface 121, the semi-cylindrical wall means 175, the inside or top surface 192 of the transverse wall 191, and the surfaces extending directly from the second or carburetor mounting surface 121 and not otherwise mentioned as being formed by the first die member.

In addition, the undercut areas 61 associated with the rectangular portions 131 of the fuel/air mixture passages 113 are formed by utilizing cores (not shown) movable relative to the first die member. Thus, the disclosed construction avoids the second, third and fourth undercut areas 85, 87 and 91 of the prior pattern assembly 11 and permits molding of the one-piece pattern 111 utilizing removable cores to form only the first undercut areas 61 associated with each of the rectangular portions 131 of the fuel/air mixture passages 113.

Of course, a one-piece pattern in accordance with the invention can include any number of fuel/air mixture passages.

Various of the features of the invention are set forth in the following claims.

I claim:

1. A one-piece foam pattern for an intake manifold for a two cycle internal combustion engine, said pattern comprising a first surface for providing an intake manifold surface adapted to engage an engine block surface and having therein a first opening, a second surface extending in generally spaced relation to said first surface and for providing an intake manifold surface adapted to engage a carburetor mounting surface, said second surface having therein a generally cylindrical opening, and a passage extending between said first and second surfaces and adapted to provide a fuel/air mixture passage in said intake manifold, said passage including a first portion extending from said first opening in said first surface and having a first transverse surface extending in spaced relation to said first and second surfaces and having therein a second opening, said passage also including a transition portion extending between said circular opening in said second surface and said second opening and being defined by semi-cylindrical wall means extending from said circular opening in said second surface and including a first axial end at said second surface and a second axial end spaced from said first end, second wall means extending from said second end of said semi-cylindrical wall means to said second opening and defining a second transverse wall generally parallel to said second surface, and third wall means extending from said circular opening and diverging to said second opening.

2. A one-piece foam pattern for an intake manifold for a two cycle internal combustion engine, said pattern comprising a first surface for providing an intake manifold surface adapted to engage an engine block surface and having therein a generally rectangular opening, a second surface extending in generally spaced and parallel relation to said first surface and for providing an intake manifold surface adapted to engage a carburetor mounting surface, said second surface having therein a generally cylindrical opening, and a passage extending between said first and second surfaces and adapted to provide a fuel/air mixture passage in the intake manifold, said passage including a first portion extending from said rectangular opening in said first surface and having a first transverse surface extending parallel to, and in spaced relation to, said first and second surfaces and having therein a second rectangular opening, said passage also including a transition portion extending between said circular opening in said second surface and said second rectangular opening and being defined by semi-cylindrical wall means extending from said circular opening in said second surface and including a first axial end at said second surface and a second axial end spaced from said first end, second wall means extending from said second end of said semi-cylindrical wall means to said second rectangular opening and defining a second transverse wall generally parallel to said second surface, and third wall means extending from said circular opening and diverging to said second rectangular opening.

3. A one-piece foam pattern in accordance with claim 2 wherein said second rectangular opening is defined by two end edges and by a first side edge extending in a plane generally bisecting said cylindrical opening and approximately dividing said cylindrical opening into first and second half portions, said first side edge having a central portion, and said second rectangular opening also being defined by a second side edge, wherein said semi-cylindrical wall means extends from said first half portion of said circular opening, wherein said second wall means extends to said central portion of said first side edge of said second rectangular opening, and wherein said third wall means extends from said second half portion of said circular opening to said second side edge and to said end edges of said second rectangular opening.

4. A one-piece foam pattern in accordance with claim 3 wherein said first side edge also includes first and second end portions, wherein said semi-cylindrical wall means includes first and second arcuately spaced and axially extending sides and wherein said transition portion also includes fourth wall means extending from said first side of said semi-cylindrical wall means to said first end portion of said first side edge and extending to said third wall means, and fifth wall means extending from said second side of said semi-cylindrical wall means to said second end portion of said first side edge and extending to said third wall means.

5. A one-piece lost foam pattern in accordance with claim 2 including a second rectangular opening located in said first surface and in spaced aligned relation to said first-mentioned rectangular opening, a second circular opening located in said second surface and in spaced aligned relation to said first circular opening, and a second passage extending between said second rectangular opening in said first surface and said second circular opening in said second surface, said second passage including a rectangular opening intermediate said first and second surfaces, and a transition portion extending between said last mentioned rectangular opening and said second circular opening in said second surface, and a reinforcing rib extending directly between said transition portion of said first-mentioned passage and said transition portion of said second passage.

6. A one-piece lost foam pattern in accordance with claim 5 wherein said second transition portion is defined by semi-cylindrical wall means extending from said second circular opening in said second surface and including a first axial end at said second surface and a second axial end spaced from said first end, second wall means extending from said second end of said semi-cylindrical wall means of said second transition portion to said second rectangular opening and defining a second transverse wall generally parallel to said second surface, and third wall means extending from said second circular opening and diverging to said second rectangular opening, said reinforcing rib extending between said semi-cylindrical wall means of said first-mentioned transition portion and said third wall means of said second transition portion.

7. A one-piece foam pattern for an intake manifold for a two cycle internal combustion engine, said pattern comprising a first surface for providing an intake manifold surface adapted to engage an engine block surface and having therein a generally rectangular opening, a second surface extending in generally spaced and parallel relation to said first surface and for providing an intake manifold surface adapted to engage a carburetor mounting surface, said second surface having therein a generally cylindrical opening, and a passage extending between said first and second surfaces and adapted to provide a fuel/air mixture passage in the intake manifold, said passage including a first portion extending from said rectangular opening in said first surface and having a first transverse surface extending parallel to, and in spaced relation to, said first and second surfaces and having therein a second rectangular opening of lesser size than said rectangular opening in said first surface, said second rectangular opening being defined by two end edges and by a first side edge extending in a plane generally bisecting said cylindrical opening and approximately dividing said cylindrical opening into first and second half portions, said first side edge having a central portion and first and second end portions extending from said central portion, and said second rectangular opening also being defined by a second side edge, said passage also including a transition portion extending between said circular opening in said second surface and said second rectangular opening and being defined by semi-cylindrical wall means extending from said first half portion of said circular opening in said second surface and including a first axial end at said second surface, a second axial end spaced from said first end, and first and second arcuately spaced and axially extending sides, and second wall means extending from said second end of said semi-cylindrical wall means to said central portion of said first side edge of said second rectangular opening and defining a second transverse wall generally parallel to said second surface, third wall means extending from said second half portion of said circular opening and diverging to said second side edge and to said end edges of said second rectangular opening, fourth wall means extending from said first side of said semi-cylindrical wall means to said first end portion of said first side edge and extending to said third wall means, and fifth wall means extending from said second side of said semi-cylindrical wall means to said second end portion of said first side edge and extending to said third wall means.

8. A one-piece lost foam pattern in accordance with claim 7 including a second rectangular opening located in said first surface and in spaced aligned relation to said first-mentioned rectangular opening, a second circular opening located in said second surface and in spaced aligned relation to said first circular opening, and a second passage extending between said second rectangular opening in said first surface and said second circular opening in said second surface, said second passage including a transition portion, and a reinforcing rib extending directly between said transition portion of said first-mentioned passage and said transition portion of said second passage.

* * * * *